United States Patent [19]

Wilson

[11] 4,222,866

[45] Sep. 16, 1980

[54] FILTER BOX

[76] Inventor: Wade Wilson, 2712 Finch St., Baton Rouge, La. 70807

[21] Appl. No.: 1,291

[22] Filed: Jan. 5, 1979

[51] Int. Cl.[2] ..... B07B 1/02

[52] U.S. Cl. ..... 209/417; 209/257

[58] Field of Search ..... 209/233, 235, 252, 352, 209/376, 405, 408, 417, 418, 420, 257

[56] References Cited

U.S. PATENT DOCUMENTS

| | | | |
|---|---|---|---|
| 20,000 | 4/1858 | McNiell | 209/376 |
| 1,593,447 | 7/1926 | Friedman | 209/417 |

*Primary Examiner*—Ralph J. Hill

*Attorney, Agent, or Firm*—David L. Ray; Edgar E. Spielman, Jr.

[57] ABSTRACT

A filter box for filtering trash from sand is disclosed. The box features a rectangular portion and a trapezoidal portion. The trapezoidal portion is enclosed by tapered sidewalls and an overlying trapezoidal top wall to form a funnel. The rectangular portion has upwardly projecting sidewalls which connect with the tapered sidewalls. A screen is fitted within the sidewalls of the rectangular portion and is utilized to filter, from sand, any trash that may be present. The filtered sand is then replaced into the receptacle from which it came by pouring it through the formed funnel of the filter box of this invention.

4 Claims, 6 Drawing Figures

FILTER BOX

BACKGROUND OF THE INVENTION

In public places the utilization of sand urns which use sand for snuffing smoking material, i.e. cigarettes, cigars, etc., is widespread. After a time these urns become heavily litered with the extinguished smoking material so that it and other trash must be removed from the snuffing sand. It is presently common practice for a person to achieve this separation by either dumping the entire contents of the urn and replacing the sand or by meticulously removing the trash by hand from the sand. The former method is not desirable as it requires that the person carry with him a quantity of sand which is bulky and heavy. The removal by hand of the smoking material and other trash is a health hazard, distasteful, to say the least, and time consuming.

Disclosing various filtering devices are U.S. Pat. No. 378,765, U.S. Pat. No. 1,933,561, U.S. Pat. No. 2,037,078, U.S. Pat. No. 2,679,935, and U.S. Pat. No. 3,802,560.

Therefore it is an object of this invention to provide a filter box which is capable of removing smoking material and other trash from sand urns and which allows for return of the filtered sand to the sand urn without the person ever having to come in contact with the litered sand.

THE INVENTION

This invention relates to a filter box for filtering trash from sand, said box comprising: a hexagonal bottom wall having a rectangular portion and a trapezoidal portion; a sidewall connected to and upwardly extending from each of the outer edges of the rectangular portion; a tapered sidewall connected to and upwardly extending from each of the outer side edges of the trapezoidal portions, the tapered sidewalls being tapered downwardly towards the top end of the trapezoidal portion, and the tapered sidewalls being connected at their widest extent to the sidewalls at their ends most proximate the top of the trapezoidal portion; a trapezoidal top wall overlaying at least a portion of the trapezoidal portion and connected to the tapered sidewalls to form a funnel with the trapezoidal portion and the tapered sidewalls; and a removable screen fittable within the sidewalls.

Preferably the screen is held within a rectangular peripheral frame which will insure that the screen fits diagonally into the recess formed by the sidewalls of the rectangular portion. The frame may additionally have a projecting lip so that the person may obtain a grip on the screen frame for ease in its removal so that the smoking material and trash can be dumped from the screen to a trash receptacle. The formed funnel facilitates in replacing the sand to the urn without the person ever having to come in actual contact with the sand.

The above-described filter box can be made of sheet metal, e.g. 1/16 galvanized steel. Due to the unique design of the filter box of this invention it is possible to cut such steel metal out of a single piece and—with proper folding and soldering—form the box. This procedure would be well-known to those skilled in the sheet metal art.

In use, the filter box of this invention is the paragon of simplicity. The person need only pour the sand and trash directly onto the screen. The sand urn is replaced to its normal upright position and the filtered sand which has passed through the screen is poured through the before-described funnel back to the sand urn. The screen with the captured trash is removed from the box so that the screen may be emptied of the trash into a suitable trash container. The screen is then returned to the filter box and the next sand urn is likewise treated. Using this procedure, the person need never come into contact with the sand or trash nor need the person carry with him or her a supply of replacement sand. As can be appreciated, the filter box of this invention greatly improves the lot of the person cleaning sand urns from a health perspective and also from a time saving perspective.

These and other features of this invention contributing satisfaction in use and economy in manufacture will be more fully understood from the following description of a preferred embodiment of the invention when taken in conjunction with the accompanying drawings in which identical numerals refer to identical parts and in which.

Figure 1:
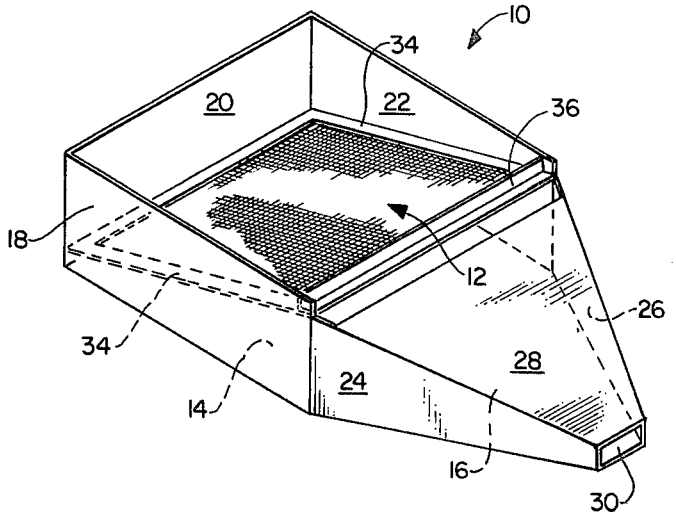
FIG. 1 is a perspective view of a filter box of this invention.
Figure 2:
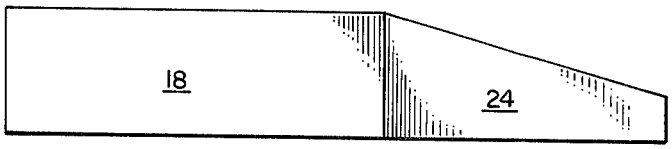
FIG. 2 is a side elevational view of the filter box shown in FIG. 1.
Figure 3:
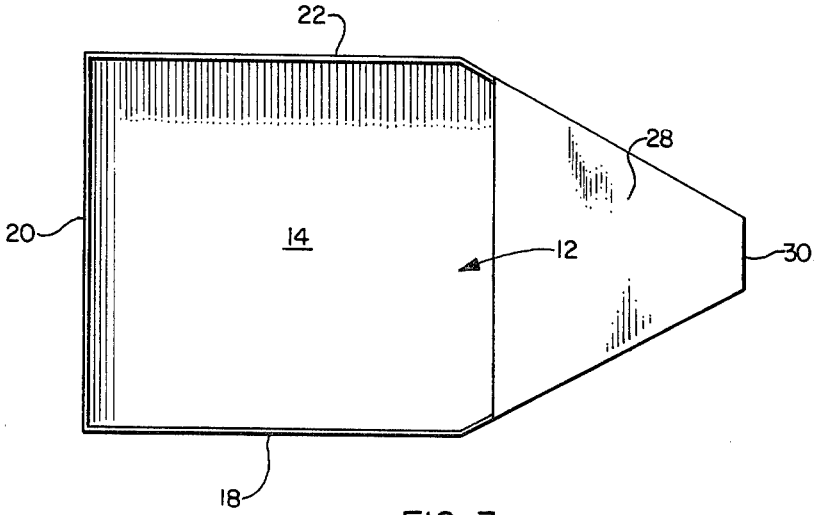
FIG. 3 is a top plan view of the filter box shown in FIG. 1 with the screen removed.

Referring now to FIGS. 1–5, it can be seen that a filter box of this invention, generally designated by the numeral 10, has a bottom wall, generally designated by the numeral 12. Bottom wall 12 has a rectangular portion 14 and a trapezoidal portion 16. Note that trapezoidal portion 16 connects to rectangular portion 14 at the broadest base of trapezoidal portion 16. Upwardly extending from the outer edges of rectangular portion 14 are sidewalls 18, 20 and 22. These sidewalls, along with rectangular portion 14, form an open ended box-like recess as can be seen in FIGS. 1 and 3. This recess will be utilized to receive the contents from the sand urn as they are filtered through screen 32.

To achieve as complete filtration as is possible, screen 32 is held within frame 34 which is dimensioned to fit snugly within the recess formed by rectangular portion 14 and sidewalls 18, 20 and 22, as can be seen in FIG. 1. Frame 34 may be made of sheet metal and appropriately affixed to screen 32. At the forwardmost edge of frame 34 there is provided an upwardly extending lip 36 which will be utilized by the user of the filter box to obtain a grip on frame 34 and screen 32. This lip will ease the removal of the screen from filter box 10.

Projecting upwardly from trapezoidal portion 16 are tapered sidewalls 24 and 26. As can be seen, these sidewalls project upwardly from trapezoidal portion 16 at its outer side edges. Overlaying trapezoidal portion 16 and connected to the uppermost edges of tapered sidewalls 24 and 26 is trapezoidal top wall 28. Trapezoidal top wall 28 may overlay all of trapezoidal portion 16 or may overlay just a portion thereof, it being understood however that a sufficient amount of overlaying must be achieved so that sand will not be spilled as it passes through the funnel discharge aperture 30.

Figure 4:
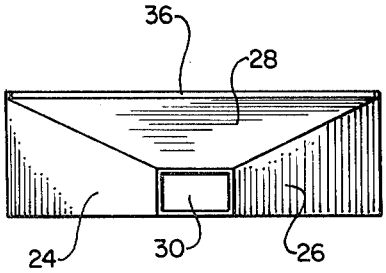
FIG. 4 is a front elevational view of the filter box shown in FIG. 1.
Figure 5:
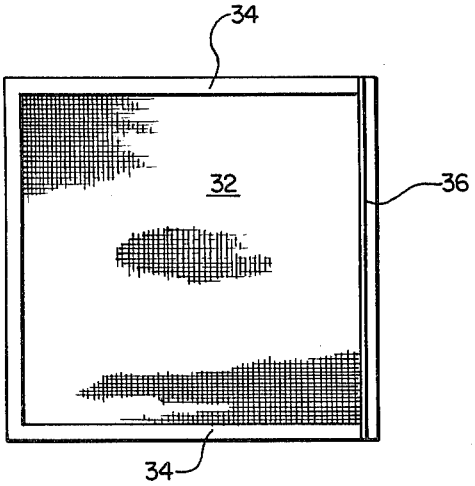
FIG. 5 is a top plan view of the screen shown in FIG. 1.
Figure 6:
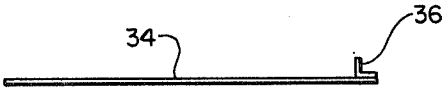
FIG. 6 is a side elevational view of the screen shown in FIG. 5.

FIGS. 1, 3 and 4 clearly illustrate the funnel-like construction formed by trapezoidal portion 16, tapered sidewalls 24 and 26, and trapezoidal top wall 28. This funnel-like construction will facilitate the pouring of the filtered sand back into the sand urn in a neat and efficient manner. Discharge aperture 30 should be of a size sufficient to allow free-flow of the filtered sand. Generally speaking, it has been found that a discharge aperture having a 2-square inch cross-sectional area is sufficient.

The size of the mesh of filter screen 32 will depend upon the courseness of the sand and the extent of filtering desired. For most purposes, common wire window screen has been found suitable. Preferably the screen should be of a non-corrosive material such as aluminum.

What is claimed is:

1. A filter box for filtering trash from sand, said box comprising:

a. a hexagonal bottom wall, having a rectangular portion and a trapezoidal portion;

b. a sidewall connected to and upwardly extending from each of the outer edges of said rectangular portion;

c. a tapered sidewall connected to and upwardly extending from each of the non-parallel edges of said trapezoidal portion, said tapered sidewalls being tapered downwardly towards the top end of said trapezoidal portion, and said tapered sidewalls being connected at their widest extent to said sidewalls at their ends most proximate said top of said trapezoidal portion;

d. a trapezoidal top wall overlaying at least a portion of said trapezoidal portion and connected to said tapered sidewalls to form an open ended funnel with said trapezoidal portion and said tapered sidewalls; and e. a rectangular removable screen fittable within said sidewalls, said screen resting on one of its edges on said top wall and on the edge opposite, on said bottom wall.

2. The box of claim 1 wherein said screen is held within a rectangular, peripheral frame.

3. The box of claim 2 wherein said frame has an upwardly projecting lip for gripping said screen and frame for their removal from said box.

4. The box of claim 1 wherein said filter box is of sheet metal.

* * * * *